US010174528B2

(12) United States Patent
Velicanin

(10) Patent No.: US 10,174,528 B2
(45) Date of Patent: Jan. 8, 2019

(54) MOTOR VEHICLE DOOR HANDLE

(71) Applicants: HUF HÜLSBECK & FÜRST GMBH & CO. KG, Velbert (DE); Mensur Velicanin, Velbert (DE)

(72) Inventor: Mensur Velicanin, Velbert (DE)

(73) Assignee: HUF HUELSBECK & FUERST GMBH & CO. KG, Velbert (DE)

( * ) Notice: Subject to any disclaimer, the term of this patent is extended or adjusted under 35 U.S.C. 154(b) by 269 days.

(21) Appl. No.: 14/916,784

(22) PCT Filed: Aug. 19, 2014

(86) PCT No.: PCT/EP2014/002272

§ 371 (c)(1),
(2) Date: Mar. 4, 2016

(87) PCT Pub. No.: WO2015/043705

PCT Pub. Date: Apr. 2, 2015

(65) Prior Publication Data

US 2016/0222705 A1 Aug. 4, 2016

(30) Foreign Application Priority Data

Sep. 27, 2013 (DE) ..... 10 2013 016 049
Oct. 25, 2013 (DE) ..... 10 2013 017 664

(51) Int. Cl.
*E05B 85/10* (2014.01)
*E05B 81/06* (2014.01)

(52) U.S. Cl.
CPC ..... *E05B 85/10* (2013.01); *E05B 81/06* (2013.01); *E05B 85/103* (2013.01); *E05B 85/107* (2013.01)

(58) Field of Classification Search
CPC ..... E05B 5/003; E05B 5/006; E05B 85/103; E05B 85/107

(Continued)

(56) References Cited

U.S. PATENT DOCUMENTS 3,993,338 A * 11/1976 Cherbourg ..... B60J 5/06 292/336.3
5,123,687 A * 6/1992 Pfeiffer ..... E05B 1/0092 292/336.3

(Continued)

FOREIGN PATENT DOCUMENTS

DE 3427178 A1 * 2/1986 ..... E05B 85/18
DE 4002963 C1 7/1991

(Continued)

OTHER PUBLICATIONS

International Search Report (ISR) dated Feb. 4, 2015, for PCT/EP2014/002272.

*Primary Examiner* — Carlos Lugo
(74) *Attorney, Agent, or Firm* — Bacon & Thomas, PLLC

(57) ABSTRACT

The invention relates to a motor vehicle door handle for locking and/or activating a door of a motor vehicle, having a handle housing and a pulling handle arranged in the handle housing, wherein in a closed position the pulling handle terminates flush with the handle housing and/or rests in the handle housing and can be moved into an operating position in which the pulling handle protrudes outward from the handle housing and it can be gripped from the rear, wherein when the pulling handle is pulled manually in the operating position the door lock and/or the door opens, wherein the pulling handle has two articulation points spaced apart from one another, wherein the pulling handle is mounted at the first articulation point in an articulated fashion at one end of a first rotary lever, and is mounted spaced apart therefrom at the second articulation point in an articulated fashion at one end of a second rotary lever, wherein the two rotary levers rotate about rotational axes in order to move the pulling handle from the closed position into the operating position.

9 Claims, 10 Drawing Sheets

(58) Field of Classification Search
USPC ..... 292/336.3
See application file for complete search history.

(56) References Cited

U.S. PATENT DOCUMENTS

| | | | | | |
|---|---|---|---|---|---|
| 5,632,516 | A * | 5/1997 | Schwab | E05B 85/18 | 292/336.3 |
| 5,975,597 | A * | 11/1999 | Makiuchi | E05B 85/16 | 292/336.3 |
| 6,062,614 | A * | 5/2000 | Petzold | E05B 85/14 | 292/336.3 |
| 6,698,262 | B2 * | 3/2004 | Wittwer | E05B 85/107 | 292/336.3 |
| 8,701,353 | B2 * | 4/2014 | Patel | E05B 81/34 | 292/144 |
| 8,919,047 | B2 * | 12/2014 | Johnsrud | E05B 85/103 | 292/336.3 |
| 9,249,608 | B2 * | 2/2016 | Lang | E05B 85/103 | |
| 2013/0076048 | A1 | 3/2013 | Aerts et al. | | |

FOREIGN PATENT DOCUMENTS

| | | | | | |
|---|---|---|---|---|---|
| DE | 4343977 | A1 * | 6/1995 | A47L 15/4259 | |
| DE | 19731325 | A1 | 1/1999 | | |
| DE | 29914393 | U1 * | 11/1999 | E05B 17/14 | |
| DE | 10015887 | C1 | 1/2002 | | |
| DE | 102004036663 | A1 | 3/2006 | | |
| DE | 102009016219 | A1 * | 10/2010 | B60J 5/101 | |
| DE | 102010016869 | A1 * | 11/2011 | E05B 85/107 | |
| DE | 102015115673 | A1 * | 3/2017 | E05B 85/107 | |
| EP | 1072466 | A2 * | 1/2001 | B60N 3/023 | |
| EP | 1403453 | A1 * | 3/2007 | | |
| FR | 2760721 | A1 * | 9/1998 | A45C 13/22 | |
| GB | 2477085 | A | 7/2011 | | |
| WO | WO-2016041996 | A1 * | 3/2016 | E05B 85/107 | |

* cited by examiner

MOTOR VEHICLE DOOR HANDLE

BACKGROUND OF THE INVENTION

The invention relates to a motor vehicle door handle for actuating a door lock and/or a door of a motor vehicle, having a handle housing and a pulling handle arranged in the handle housing, wherein the pulling handle terminates flush with the handle housing and/or rests in the handle housing in a closed position and can be displaced into an operating position, in which the pulling handle protrudes outwardly from the handle housing and can be gripped from the rear, wherein the door lock and/or the door opens when manually pulling the pulling handle in the operating position.

Such door handles that have a pulling handle which in its resting or closed position terminates flush with the body of the vehicle or the handle housing are known, for example, from DE 100 15 887 C1 and DE 10 2004 036 663 A1.

Said documents disclose door handles for a motor vehicle, comprising a handle housing and a pulling handle pivotally arranged in the handle housing, which pulling handle terminates flush with the body of a motor vehicle or a handle housing in a closed and resting position, wherein the pulling handle can be displaced into an operating position protruding outwardly from the vehicle body, in which the pulling handle can be gripped from the rear, and wherein the door lock and/or the door opens when pulling the pulling handle.

SUMMARY OF THE INVENTION

A disadvantage of the known motor vehicle door handles is that said handles have very complex structures in order to enable displacing the pulling handle from its resting and closed position into its operating position.

It is therefore the object of the invention to develop a generic motor vehicle door handle for actuating a door lock and/or a door of a motor vehicle such that said handle can be displaced from its closed position into its operating position by means of a simplified, mechanically stable mechanism.

Said object is achieved by a motor vehicle door handle according to claim 1. Advantageous developments of the invention are specified in the sub claims.

It is of particular advantage in the motor vehicle door handle for actuating a door lock and/or a door of a motor vehicle, having a handle housing (1) and a pulling handle (2) arranged in the handle housing (1), wherein in a closed position the handle (2) terminates flush with the handle housing (1) and/or rests in the handle housing (1) and can be displaced into an operating position, in which the pulling handle (2) protrudes outwardly from the handle housing (1) and can be gripped from the rear, wherein when the pulling handle (2) is pulled manually in the operating position the door lock and/or the door opens, that the pulling handle (2) comprises two articulation points (21, 22) spaced apart from each other, wherein the pulling handle (2) is supported on the first articulation point (21) in an articulated fashion at one end of a first rotary lever (10) and is supported spaced apart therefrom at the second articulation point (22) in an articulated fashion at one end of a second rotary lever (20), wherein the two rotary levers (10, 20) rotate about rotational axes (11, 12) in order to displace the pulling handle (2) from the closed position into the operating position.

Due to the fact that the pulling handle is arranged on two rotary levers via two articulation points which are spaced from one another, which rotate around pivoting axes again spaced from one another, a robust and simple kinematic is achieved, which realizes the displacement of the pulling handle from the closing position, in which the pulling handle terminates flush with the handle housing or rests in the handle housing in a rebounding manner, into the operating position, in which the pulling handle is displaced outwardly and can be gripped from the rear. Thus, the invention advantageously enables displacing the pulling handle from its closed and resting position into its operating position.

Here, the rotational axes, around which the rotary levers are rotated when the pulling handle is displaced, may run parallel to one another at a distance or may be skew to one another or intersect at a point outside of the handle housing.

The terms resting position and closing position are used synonymously in the context of the invention and describe the position in which the pulling handle terminates flush with the handle housing or rests in the handle housing in a rebounding manner.

Preferably, the articulation points are arranged successively in the extension direction of the pulling handle. Here, the extension direction refers to the direction outwards from the handle housing, i.e. the direction that corresponds to the main movement direction of the pulling handle from the closing position to the operating position.

Preferably, the rotational axes, around which the rotary levers rotate when the pulling handle is displaced, are also arranged successively in the extension direction of the pulling handle.

Here, the distance of the two articulation points of the pulling handle and the distance of the rotational axes of the two rotary levers may be equal, so that the articulation points and the rotational axes of the two rotary levers form corner points of a parallelogram. This means that upon pivoting the rotary levers, the two connection lines between the articulation point and pivot point of the first rotary lever each run parallel to the connection line of the second articulation point and the rotational axis of the second rotary lever and thus span a parallelogram. However, this is not mandatory. As an alternative, the distance of the articulation points may differ from the distance of the rotational axes of the rotary levers, such that a trapezoid is spanned.

However, the respectively resulting kinematic is advantageous, which results in that the pulling handle is displaceable from its closing position within the handle housing into its operating position, wherein due to the fact that the pulling handle is moved out of the handle housing on a bow-shaped path articulated via two articulation points spaced from one another on two rotary levers, which levers are per se pivotable around two pivot axes spaced from one another, without that the inclination of the pulling handle relative to the handle housing changes substantially, since it is undesired for esthetical reasons for the pulling handle to be pivoted out into its operating position on a circular path and changes its inclination relative to the handle housing substantially during said process.

Thus, the invention provides a simple and robust mechanism which allows the desired movement of the pulling handle from its closed position to its operating position and back.

Preferably, the motor vehicle door handle has an actuation lever which acts on at least one of the two rotary levers and pivots said lever about its rotational axes, thereby causing the displacement of the pulling handle from the closed position into the operating position.

Particularly preferably, the motor vehicle door handle comprises an electric motor drive which directly or indirectly acts on at least one of the two rotary levers and pivots said lever about its rotational axis, thereby causing the displacement of the pulling handle from the closed position to the operating position.

Particularly preferably, said electric motor drive is triggered by a locking device of the motor vehicle exchanging an access code with an external identification device via a radio connection, and the electric motor drive is automatically actuated upon determination of the access authorization, to move the pulling handle from its closed position out into the operating position.

Preferably, the motor vehicle door handle has a locking element which is indirectly or directly kinematically coupled to the pulling handle and which is engaged and locks the pulling handle in the closed position of the pulling handle, wherein the locking element is displaced into a release position by means of an actuation lever before the actuation lever acts on at least one of the two rotary levers and pivots said lever around its rotational axis.

The actuation lever, which acts on at least one of the two rotary levers, can accordingly be developed such that the actuation lever, before acting on at least one of the two rotary levers during its pivoting movement, first displaces a locking element being engaged in the closing position of the pulling handle into a release position, such that in turn the pulling handle is unlocked and displaceable into its operating position.

Said locking element, which is engaged and locks the pulling handle in its locking position, serves as accident prevention structure for preventing the pulling handle from being displaced from the closed position into the operating position due to mass inertia in the case of an impact of the vehicle, in order to ensure that the motor vehicle door won't open in the case of an accident so that protection for the vehicle passengers is maintained.

Here, the locking element can be formed by a cam, which is arranged on a front end of a pivot lever coupled to the actuation lever and which is arranged in a link or link guide on the handle housing and can be displaced from a locking position into a release position.

Here, the cam forming the locking element is kinematically coupled to the pulling handle and thus locks or latches the pulling handle in its pivot position when the cam is located in its latching position within the link on the handle housing.

After driving the cam out of the locking position, the pulling handle can in turn be displaced from its closed position to the operating position, since the cam forming the locking element is displaceable in the link of the handle housing. This allows moving the pulling handle relative to the handle housing.

In a preferred embodiment, the motor vehicle door handle comprises at least one spring element which exerts a spring force to at least one of the two rotary levers effective in the direction of the closed position.

Correspondingly, when a drive in the direction of the operating position is switched-off or removed, said spring element causes an automatic displacement of the pulling handle back into the closed position in the handle housing.

The spring element may be a coil spring, plate spring, torsion spring, spiral spring or the like. The spring action in the closing direction can thus be generated in that a force is applied to one of the rotary levers with an application point at a distance to the rotational axis, which has a component in the opposite direction to the extension direction. Alternatively or cumulatively, a torque can be applied to the rotational axis on at least one of the rotary levers in the closing direction, i.e., in the extension direction.

Preferably, the motor vehicle door handle has an actuation element which directly or indirectly acts on at least one of the two rotary levers and pivots said lever about its rotational axis upon manual actuation of the actuation element and displaces the pulling handle into the operating position.

Such a manually operable actuating element enables displacing the pulling handle from its closed position within the handle housing to its operative position outside the handle housing, in order to enable a manual pivoting of the pulling handle from its closed position into the operating position even in the case of failure of an electric motor drive or the like, and to thereby enable the actuation of the door lock as well as the motor vehicle door.

BRIEF DESCRIPTION OF THE DRAWINGS

One embodiment of the invention is illustrated in the figures and will be described in greater detail below. The figures show in.

DETAILED DESCRIPTION OF THE INVENTION

Figure 1:
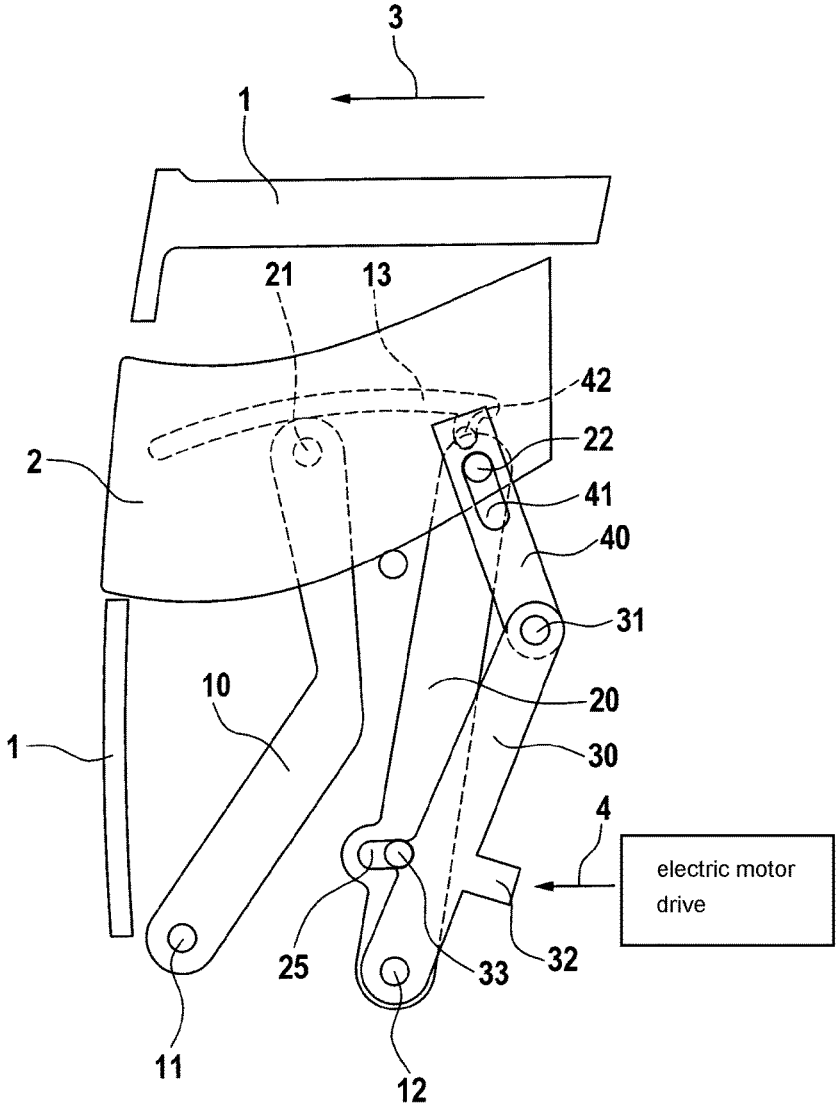
FIGS. 1 to 5 a side view of a motor vehicle door handle with various positions of the pulling handle relative to the handle housing.

In the FIGS. 1 to 10 identical components are provided with identical reference numerals. FIGS. 1 to 5 show side views of a motor vehicle door handle in various positions of the pulling handle 2 as well as the kinematic displacing the pulling handle 2 from the closed position of FIG. 1 to the operating position according to FIG. 5. The figures show the continuous movement of the pulling handle 2 relative to the handle housing 1 in a corresponding order of ascending numbers.

Figure 4:
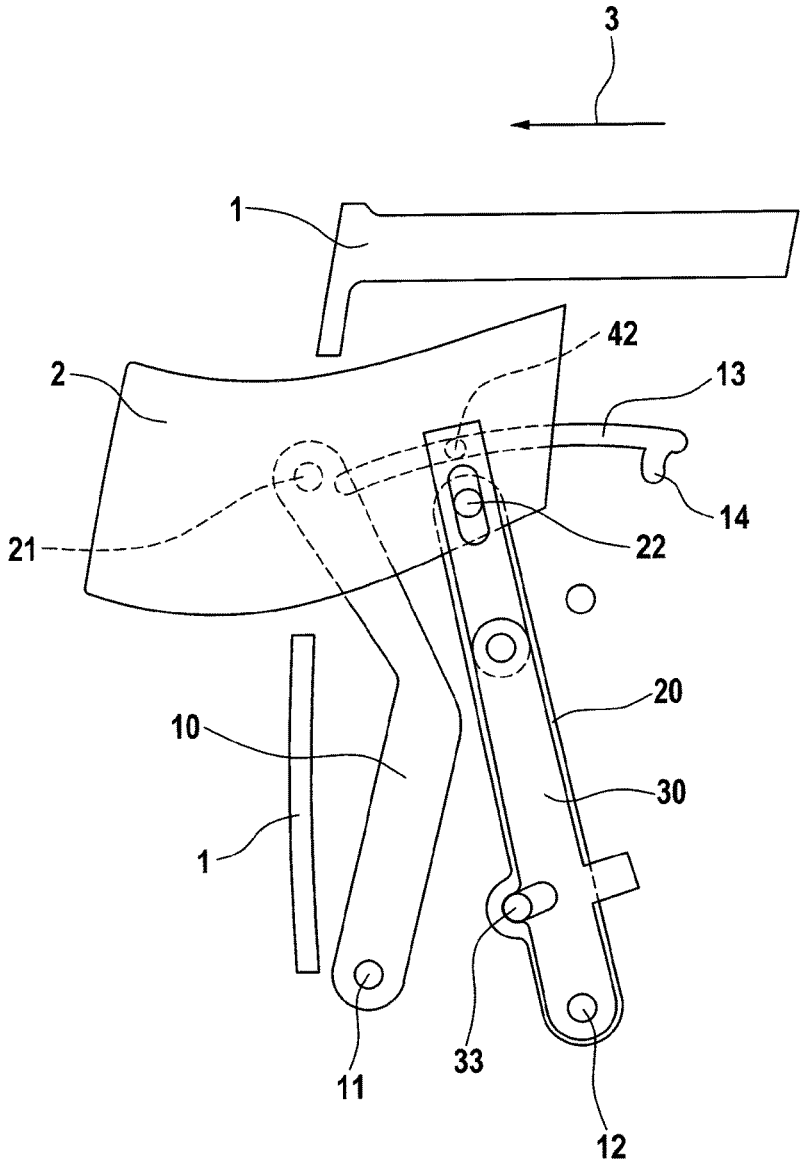
Figure 5:
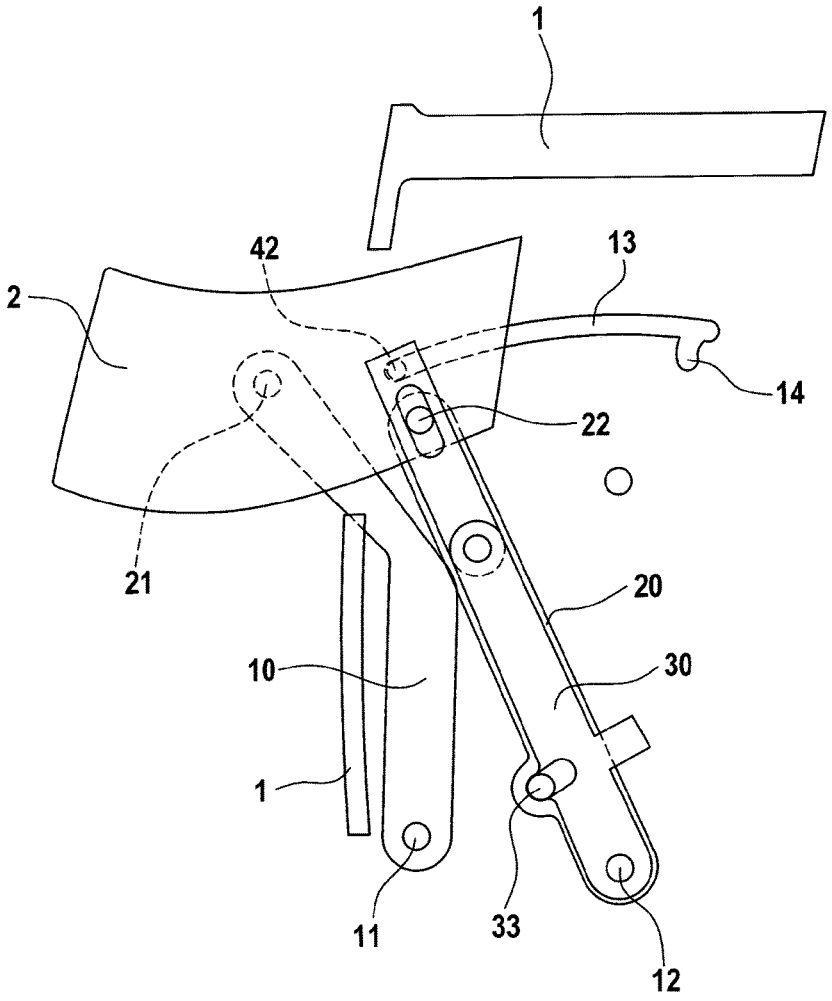
Figure 6:
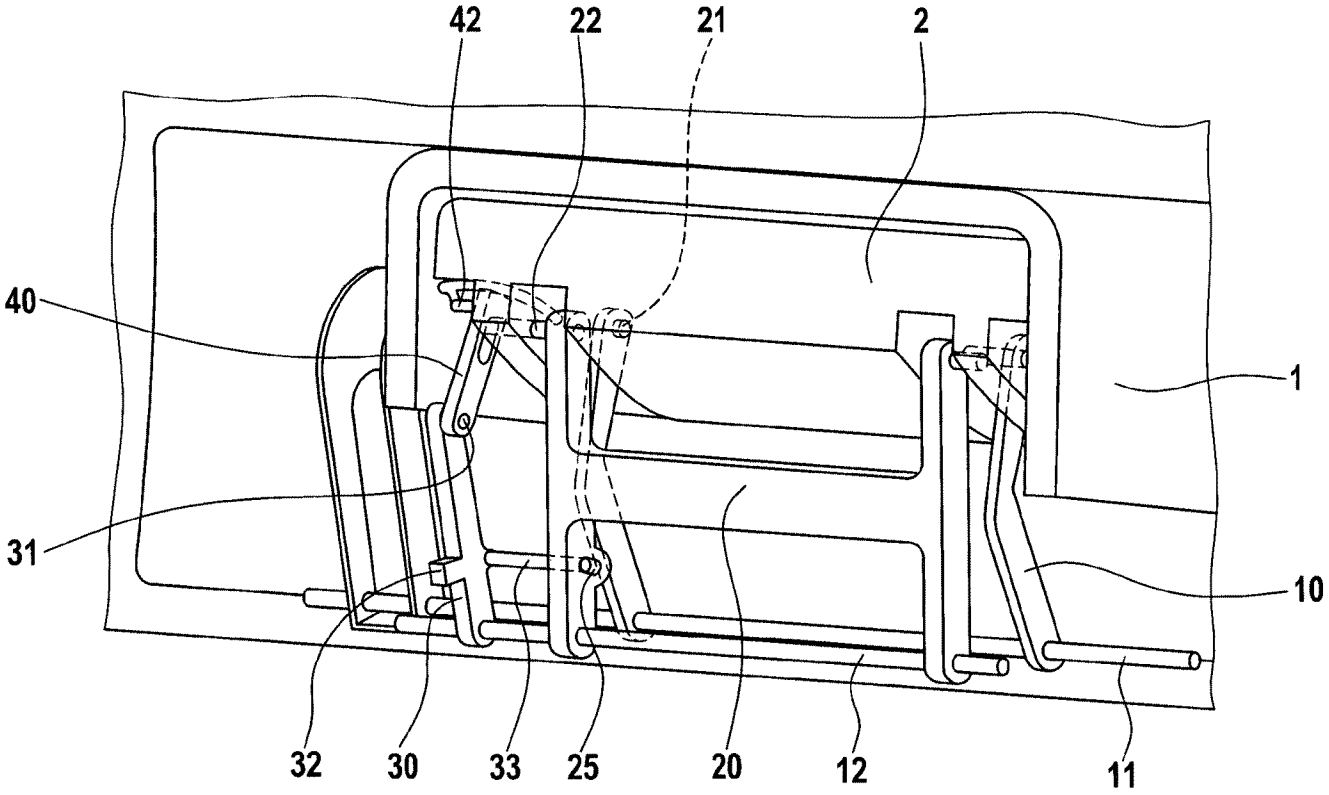
FIGS. 6 to 10 a rear view of the motor vehicle door handle according to FIGS. 1 to 5 in various positions of the pulling handle relative to the handle housing in analogy to FIGS. 1 to 5.
Figure 10:
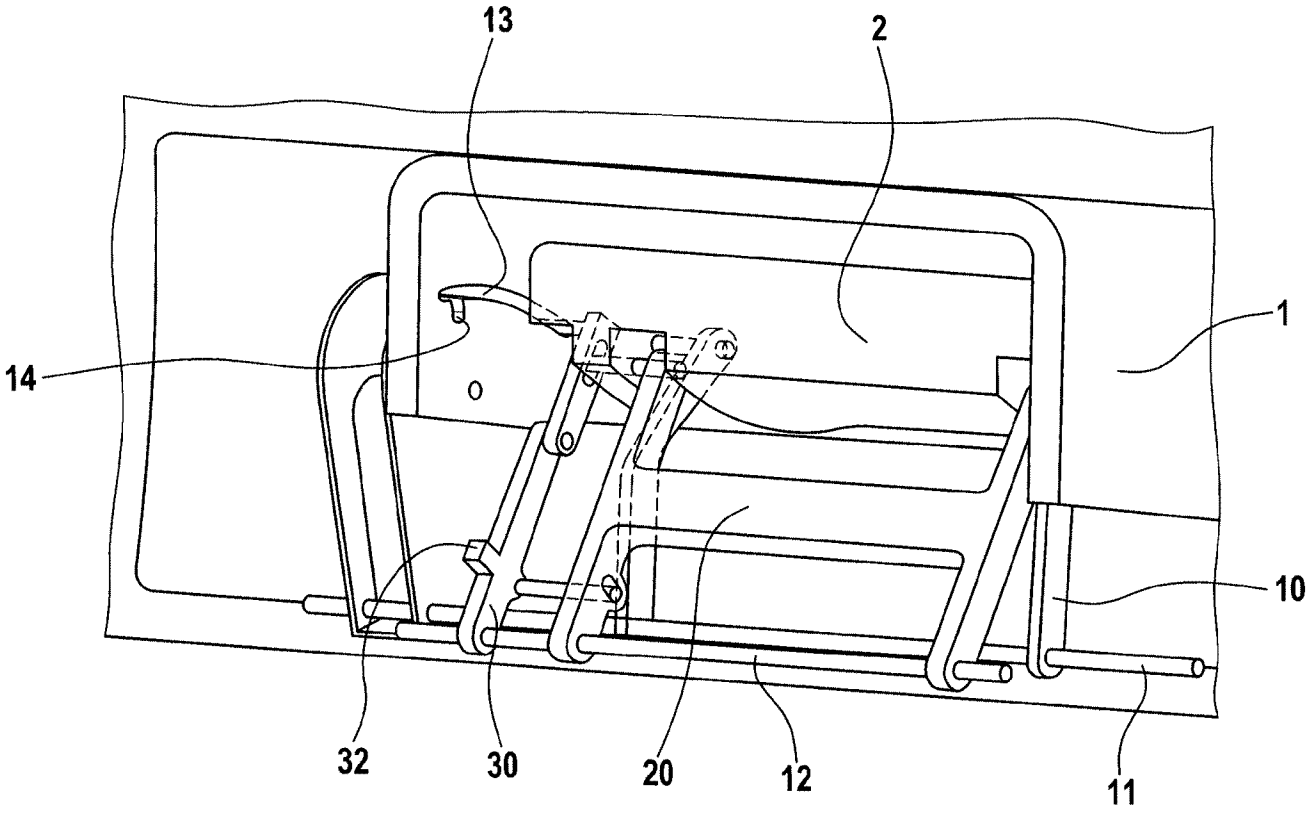

FIGS. 6 to 10 show rear views of the motor vehicle door handle in various positions of the pulling handle 2 as well as the kinematic displacing the pulling handle 2 from the closed position shown in FIG. 6 into the operating position shown in FIG. 10, where individual positions shown in FIGS. 6 to 10 correspond to the various positions according to FIGS. 1 to 5 and thus illustrate the displacement of the pulling handle 2 from the closed position into the operating position.

The pulling handle 2 of the motor vehicle door handle is arranged inside the handle housing 1, wherein the pulling handle 2 terminates flush with the handle housing 1 in the locking position illustrated in FIG. 1 or FIG. 6, respectively.

The pulling handle 2 is coupled to the upper end of the first rotary lever 10 via a first articulation point 21. The first rotary lever 10 is supported to be pivotable around its rotational axis 11. The rotational axis 11 is stationary to housing 1.

Further, the pulling handle is connected to the upper end of the second rotary lever 20 in an articulated fashion via the second articulation point 22. The second rotary lever 20 is supported to be rotatable around the rotational axis 12. The rotational axis 12 is also stationary to housing 1.

Arrow 3 of FIG. 1 characterizes the extension direction of the pulling handle 2 relative to handle housing 1.

The two articulation points 21, 22, are arranged spaced apart from one another successively in the extension direction 3, by means of which articulation points the pulling handle 2 is articulated at the two rotary levers 10, 20. The two rotational axes 11, 12 of the two rotary levers 10, 20 are also arranged successively in the extension direction 3.

An actuation lever 30, which is likewise supported in a rotatable fashion on the second rotational axis 12, is arranged in front of the second rotary lever in the image plane according to FIGS. 1 to 5.

In the representations according to FIGS. 6 to 10, said actuation lever 30 is to the left of the second rotary lever 20 and is rotatably supported on the second rotational axis 12 just like the second rotary lever 20.

For displacing the pulling handle 2 from the closed position within the handle housing 1 illustrated in FIG. 1 or FIG. 6 into the operating position illustrated in FIG. 5 or FIG. 10, in which the pulling handle 2 is pushed out of the handle housing 1, an electric motor drive acts on the actuation lever 30 via a protrusion 32 with a force component in the direction of arrow 4, which runs parallel to the extension direction 3 of the pulling handle 2.

The displacement of the pulling handle 2 via the actuation lever is apparent from the FIGS. 1 to 5 or analogous reference to FIGS. 6 to 10.

A pivot lever 40 is coupled to the actuation lever at the upper end of the actuation lever 30 through an eye 31. The pivot lever 40 has an elongated hole 41, by means of which the actuation lever slides over the axis running through the second articulation point 22, so that a relative movement of the upper end of the pivot lever 40 relative to the articulation point 22 is possible. A cam 42 acting as a locking element is arranged at the upper end of the pivot lever 40, which is in its locking position in the closed positioned shown in FIG. 1 or FIG. 6. The locking or latching position of the cam 42 is characterized in that the cam prevents a relative movement of the pulling handle 2 in this position relative to the housing 1. This is achieved in that the cam 42 is retracted into the locking position 14 within the link 13 arranged on the housing 1, wherein said locking position 14 secures the cam by the flanks to the left and the right of the link 13 and prevents a movement of the pulling handle 2 in the extension direction 3. Said locking position is constituted by a pocket-shaped receptacle 14 of the link 13, into which receptacle the cam is retracted. Because of the right and left flanks of the pocket-shaped receptacle 14, relative movement of the pulling handle 2 relative to the handle housing 1 is not possible for as long as the cam 42 is inside the locking position 14.

Said cam 42, which is engaged in the closed position of the pulling handle 2 and locks the pulling handle 2 in its locking position, serves as accident prevention structure for avoiding that the pulling handle 2 id displaced from the closed position into the operating position as a result of a pulse in a crash of the vehicle due to mass inertia. This ensures that even in the case of a strong pulse the vehicle door does not open due to an accident so that the protection of the vehicle passengers is maintained.

Figure 2:
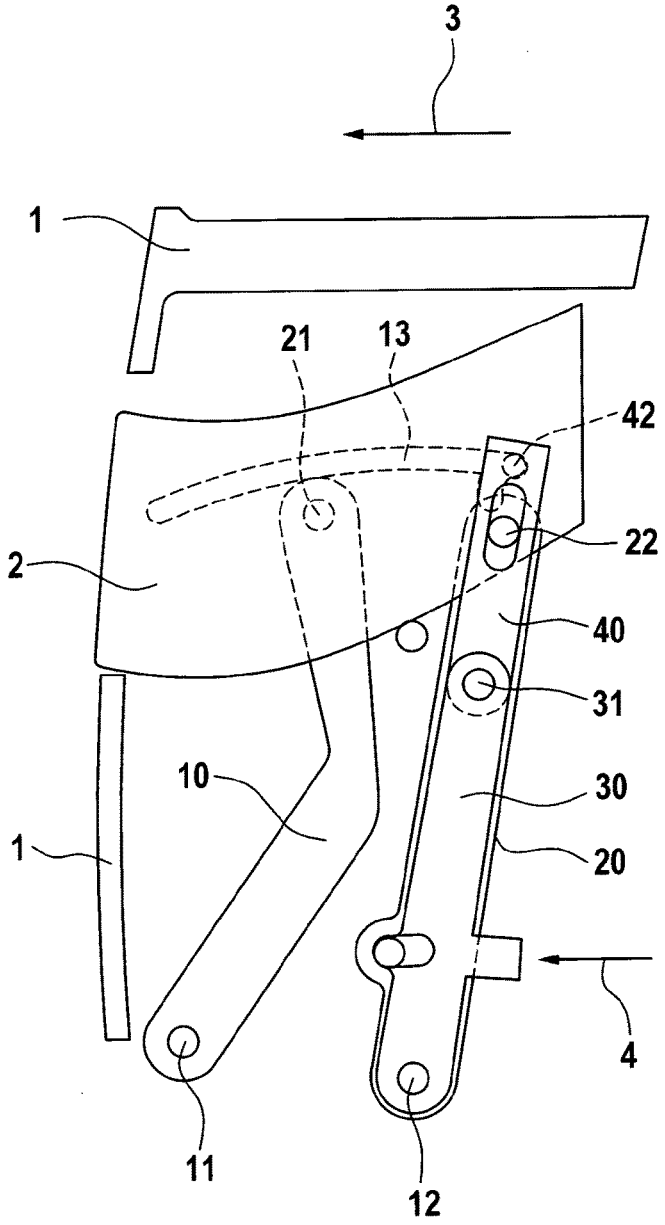
Figure 7:
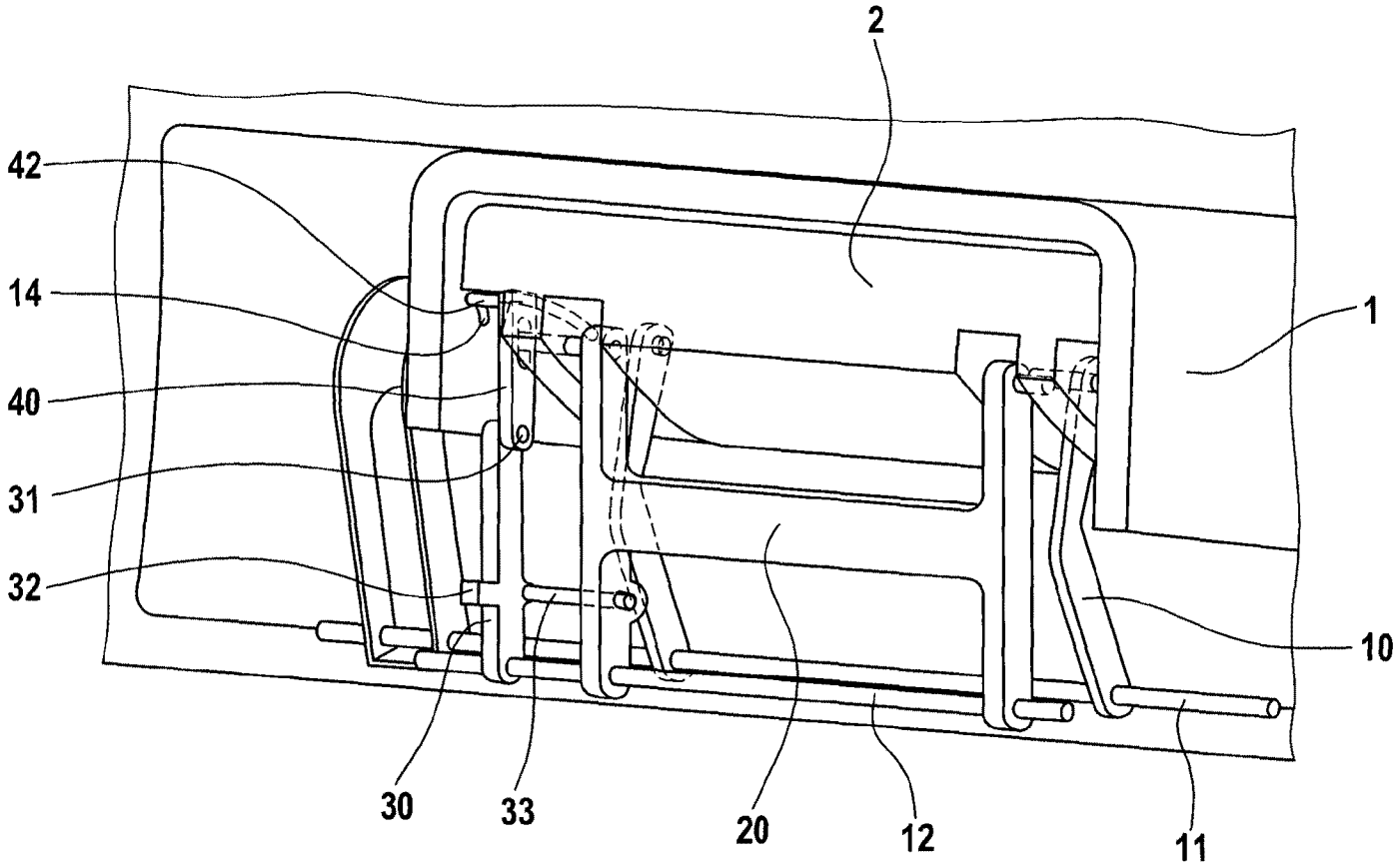
Figure 8:
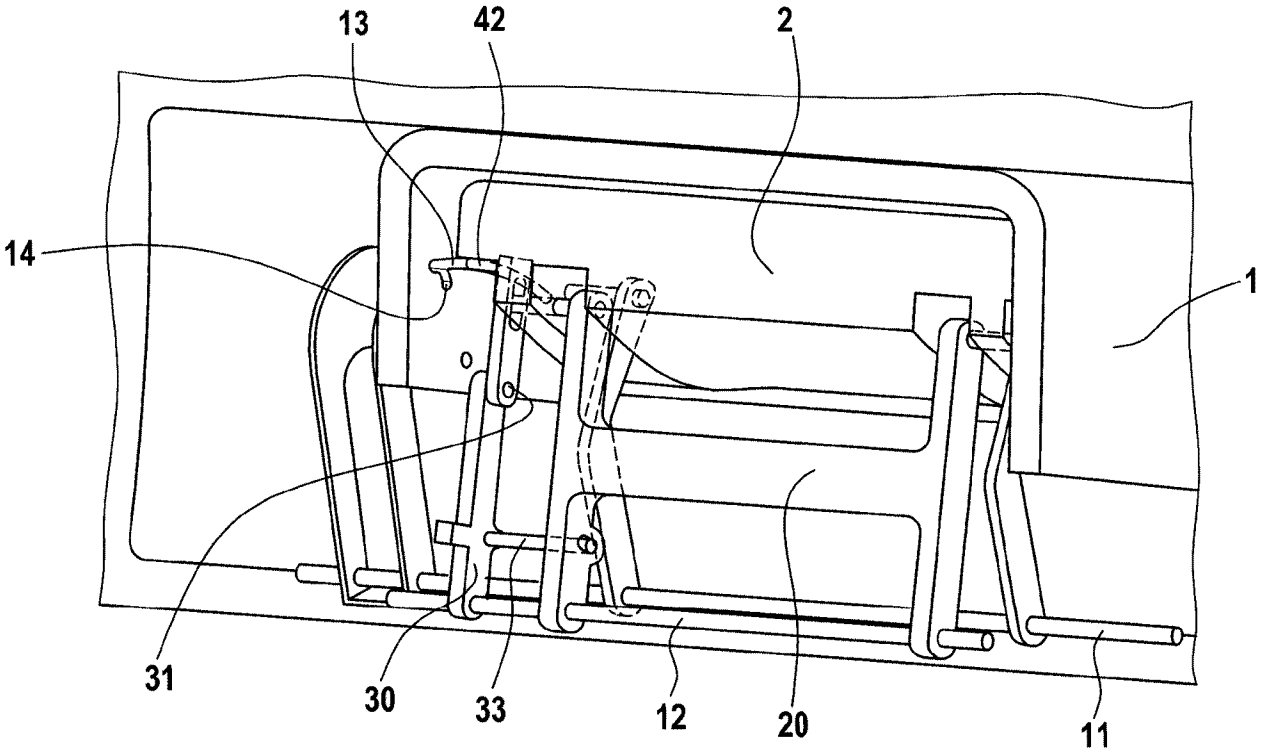
Figure 9:
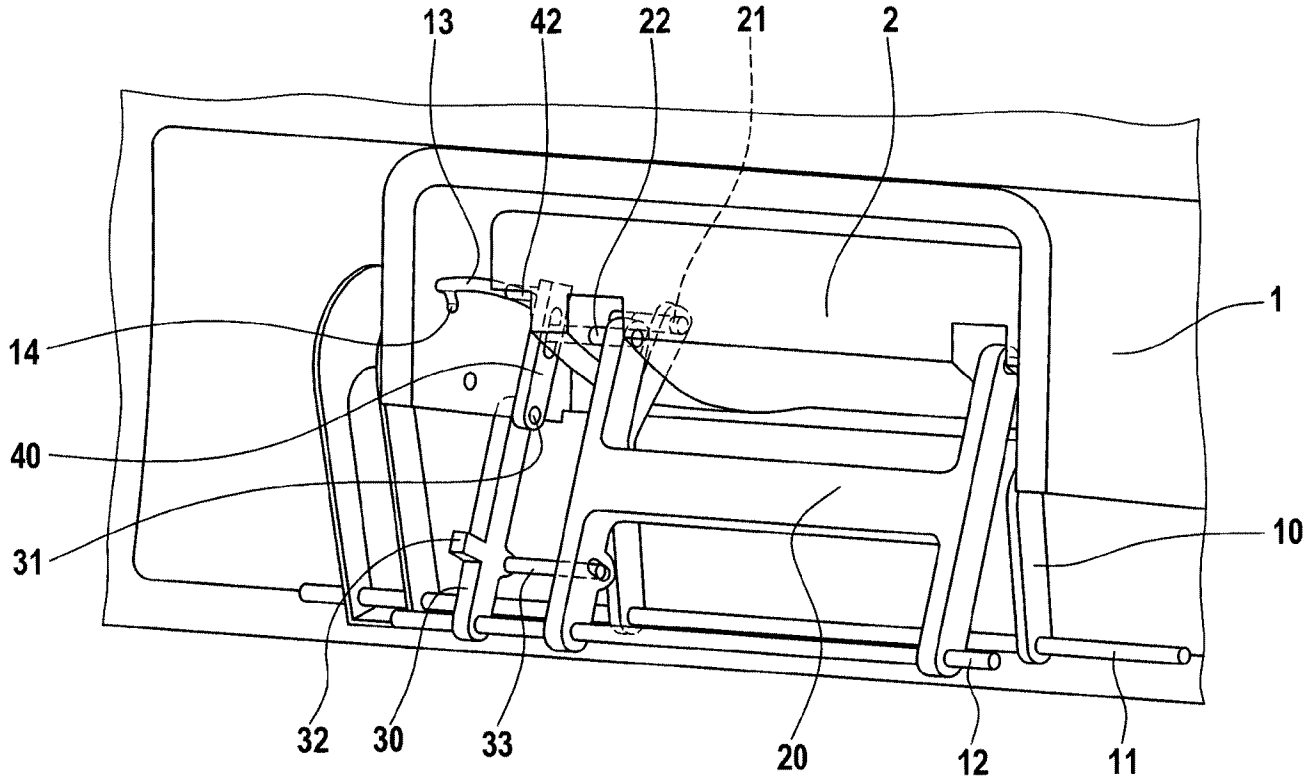

Upon actuation of the actuation lever 30 via the electric motor drive in the direction of arrow 4, the actuation lever 30 is pivoted to the left about the rotational axis 12 in the image plane according to FIGS. 1 to 5 and, via the coupling with the pivot lever 40, causes movement of the upper end of the pivot lever along the elongated hole 41 via the eye 41, whereby the cam 42 is shifted upward and out from the locking position 14 within the link 13, as shown in FIG. 2 and correspondingly in FIG. 7. Once the cam 42 has been moved inside the link 13 from out of the locking position 14, it is possible to displace the pulling handle 2 in the extension direction relative to the handle housing 1, since the link 13 is part of the stationary casing 1 This release position 10 in which the cam 42 has left the locking position 14 is shown in FIG. 2 and FIG. 7.

Further, the actuation lever 30 has a cam 33, which extends inside an elongated hole 25 in the second rotary lever 20. Here, the elongated hole 25 within the second rotary lever 20 is dimensioned such that the actuation lever 30 relative to the second rotary lever 20 is free to pivot until the cam 42, effective as a locking element, is moved from the locking position 14 of FIGS. 1 and 6 to the release position in FIGS. 2 and 7. At the instant shown in FIGS. 2 and 7, the cam 33 of the actuation lever 30 comes to stop within the elongated hole 25 of the second rotary lever 20 so that further pivoting of the actuation lever 30 around the second rotational axis 12 to the left in the image plane, in accordance with the FIGS. 1-5, then also causes a rotation of the second rotary lever 20 around the second rotation axis 12 in a counterclockwise direction.

Figure 3:
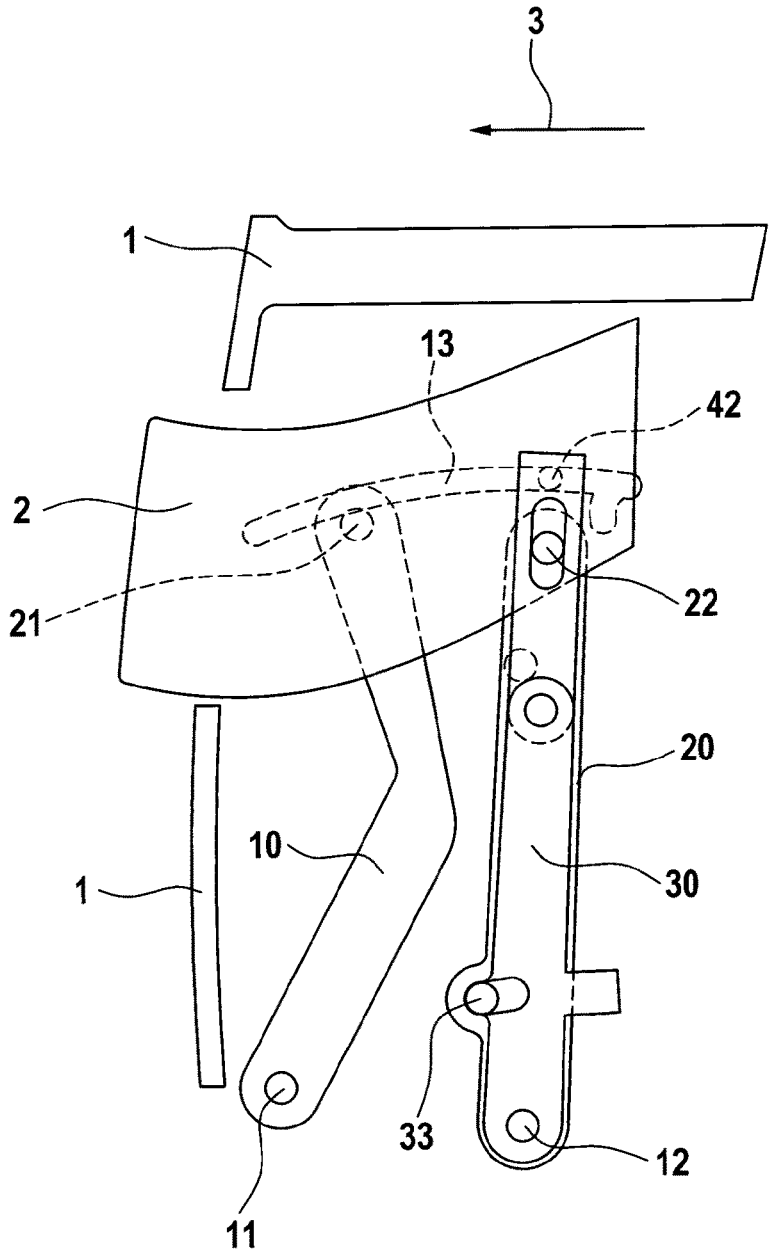

Due to the kinematic coupling of the second rotary lever 20 to the pulling handle 2 via the second articulation point 22, in the course of a further actuation of the actuation lever 30, the pulling handle 2 is displaced in the extension direction 3 from the locking position inside the housing 1 outward in the image plane according to FIGS. 1 to 5 to the left, as illustrated by FIGS. 3 and 4. Here, the cam 42 acting as a locking element slides along inside the link 13 and allows displacing the pulling handle 2 in the extension direction 3 into its operating position illustrated in FIG. 5 or FIG. 10, in which the cam 42 reaches a stop on the end of the link 13 and the pulling handle 2 is displaced into its operating position outside the handle housing 1. In the operating position of the pulling handle 2 according to FIG. 5 or FIG. 10, the pulling handle can be gripped from the rear so that by manually pulling the pulling handle the door lock unlocks and the door of the vehicle can be opened.

A retraction of the pulling handle 2 from the operating position according to FIG. 5 or FIG. 10 back into the closed position or closed position within the handle housing 1 according to FIG. 1 or FIG. 6 is effected again exactly reversed and can be understood with reference to the figures, in descending order of their numbers.

Here, the cam 42 slides along the link 13 to the right in the image plane 15 as shown in FIGS. 1 to 5, while the rotary levers 10, 20 rotate about their respective rotational axes 11, 12 in a clockwise direction. After the pulling handle 2 has reached its closed position according to FIG. 2 or 7, the actuation lever 30 is further rotated clockwise to reach the position shown in FIGS. 1 and 6 and retract the cam 42 in the locking position 14. If the position of the arrangement according to FIGS. 1 and 6 is reached again, the pulling handle 2 is locked by the latching of the cam 42 in the pocket-shaped receptacle 14.

The invention claimed is:

1. A motor vehicle door handle for actuating a door lock and/or a door of a motor vehicle, comprising a handle housing and a pulling handle arranged in the handle housing, wherein in a closed position the pulling handle terminates flush with the handle housing and/or rests in the handle housing and can be displaced into an operating position, in which the pulling handle protrudes outwardly from the handle housing and can be gripped from the rear, wherein when the pulling handle is pulled manually in the operating position the door lock and/or the door opens, wherein the pulling handle comprises two articulation points spaced apart from each other, wherein the pulling handle is supported on the first articulation point in an articulated fashion at one end of a first rotary lever and is supported spaced apart therefrom at the second articulation point in an articulated fashion at one end of a second rotary lever, wherein the two rotary levers rotate about rotational axes, to displace the pulling handle from the closed position to the operating position, wherein the motor vehicle door handle comprises a locking element, which is indirectly or directly kinematically coupled to the pulling handle and which is engaged in the closed position of the pulling handle and locks the pulling handle, wherein the locking element is displaced into a release position by means of an actuation lever before the actuation lever acts on one of the two rotary levers and pivots said lever about its rotational axis, wherein the motor vehicle door handle comprises an electric motor drive acting on the actuation lever.

2. The motor vehicle door handle according to claim 1, wherein the rotational axes run parallel to one another at a distance.

3. Motor vehicle door handle according to claim 1, wherein the articulation points are arranged successively in an extension direction of the pulling handle.

4. Motor vehicle door handle according to claim 1, wherein the rotational axes, around which the rotary levers are rotated when the pulling handle is displaced, are arranged successively in the extension direction of the pulling handle.

5. The motor vehicle door handle according to claim 1, wherein the distance of the two articulation points of the pulling handle and the distance of the rotational axes of the two rotary levers is generally equal, so that the articulation points and the rotational axes of the two rotary levers form corner points of a parallelogram.

6. The motor vehicle door handle according to claim 1, wherein the actuation lever, which acts on one of the two rotary levers and pivots said lever around its rotational axis, is configured to cause the displacement of the pulling handle from the closed position into the operating position.

7. The motor vehicle door handle according to claim 1, wherein the locking element is formed by a cam, which is arranged at a front end of a pivot lever coupled to the actuation lever and which displaceable from a latching position into a release position in a link on the handle housing.

8. Motor vehicle door handle according to claim 1, wherein the motor vehicle door handle comprises at least one spring element which exerts a spring force on at least one of the two rotary levers effective in the direction of the closed position.

9. The motor vehicle door handle according to claim 1, wherein the motor vehicle door handle comprises an actuation member which directly or indirectly acts on one of the two rotary levers and which pivots said lever around its rotational axis upon manual actuation of the actuating element and displaces the pulling handle into the operating position.

* * * * *